United States Patent [19]

Kondo et al.

[11] 4,292,485

[45] Sep. 29, 1981

[54] LEVER SWITCH WITH IMPROVED ACTUATING MEMBER

[75] Inventors: Shiro Kondo; Michitada Akazawa, both of Furukawa, Japan

[73] Assignee: Alps Electric Co., Ltd., Tokyo, Japan

[21] Appl. No.: 93,909

[22] Filed: Nov. 13, 1979

[30] Foreign Application Priority Data

Nov. 18, 1978 [JP] Japan ..... 53-159230[U]

[51] Int. Cl.[3] ..... H01H 3/06

[52] U.S. Cl. ..... 200/332; 200/339; 200/335; 200/153 T

[58] Field of Search ..... 200/153 T, 329, 330, 200/331, 332, 334, 335, 336, 337, 338; 403/316, 317

[56] References Cited

U.S. PATENT DOCUMENTS

| | | | |
|---|---|---|---|
| 2,975,004 | 3/1961 | Safianoff | 403/317 |
| 3,103,570 | 9/1963 | Gibbs | 200/339 |
| 3,367,206 | 2/1968 | Moody | 200/340 |
| 3,749,873 | 7/1973 | Harper et al. | 200/293 |
| 3,919,514 | 11/1975 | Strobel et al. | 200/153 G |
| 3,995,129 | 11/1976 | Michalski | 200/67 B |

FOREIGN PATENT DOCUMENTS

| | | | |
|---|---|---|---|
| 1406934 | 6/1965 | France | 200/339 |

*Primary Examiner*—John W. Shepperd

*Attorney, Agent, or Firm*—Guy W. Shoup; Gerard F. Dunne

[57] ABSTRACT

A lever switch has an actuating member and a cover member to be connected to each other. The actuating member includes first and second slots and notch portions. The cover member includes legs to be engaged with the notch portions of the actuating member. The first slot of the actuating member acts as a guide when it is attached to a mounting rod, and the second slot of the actuating member may support the mounting rod after the actuating member and cover member are connected, whereby the actuating member may be rotatably and removably attached to the mounting rod.

8 Claims, 6 Drawing Figures

LEVER SWITCH WITH IMPROVED ACTUATING MEMBER

BACKGROUND OF THE INVENTION

The present invention relates generally to a lever switch, and more particularly to a switch with a separately removable actuating member, suitable for use in an electrical musical instrument.

There has been proposed various switches which have an actuating lever rotatably secured to a switch frame by means of a mounting rod. In these conventional switches, however, if an actuator lever is required to be repaired or replaced, the mounting rod must be removed.

SUMMARY OF THE INVENTION

An object of the present invention is to provide a lever switch with improved actuating member.

A more specific object of the present invention is to provide an actuating member which can be easily mounted or removed from a mounting rod.

Another specific object of the present invention is to provide a multiple switch with separately removable actuating members mounted on a single mounting rod.

Other objects and advantages of the present invention will hereinafter appear.

BRIEF DESCRIPTION OF THE DRAWINGS

FIGS. *2a, 2b, 2c* and *2d* are side elevational views of the switch for attaching an actuator member to a mounting rod.

DESCRIPTION OF THE PREFERRED EMBODIMENT

Figure 1:
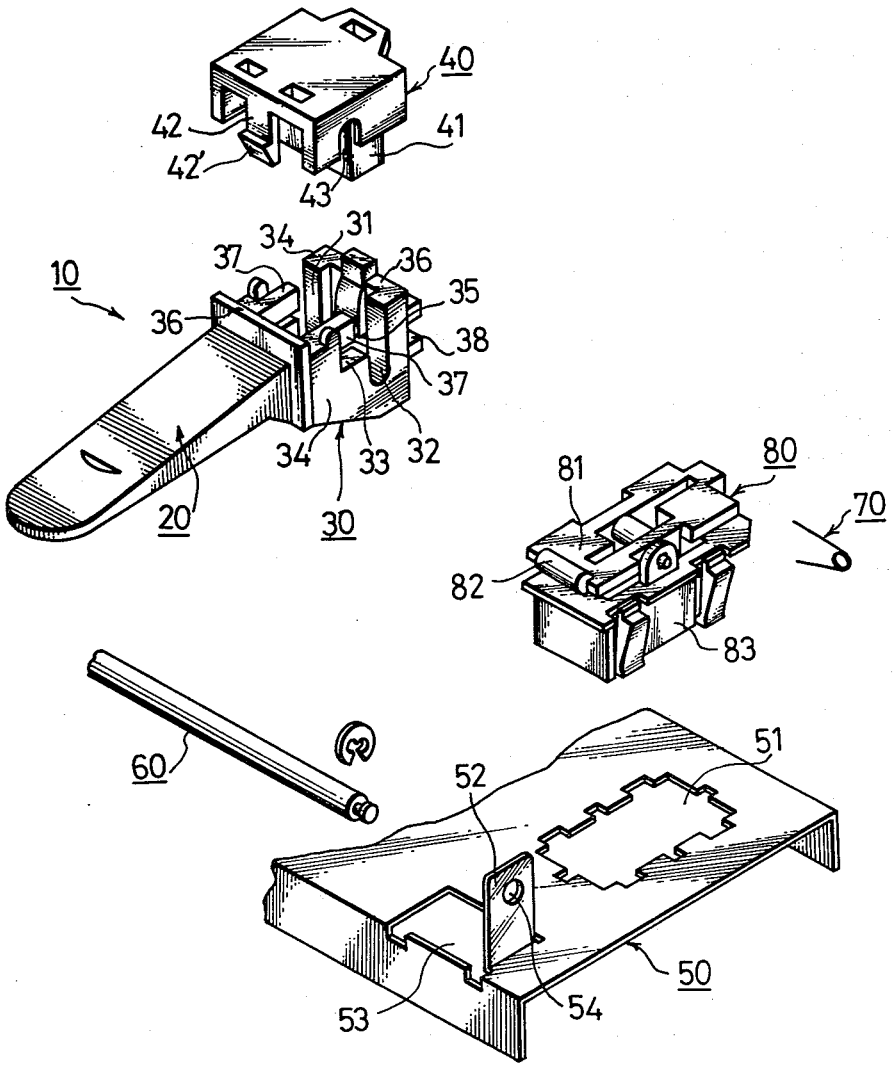
FIG. 1 is an exploded perspective view of the switch according to the invention.
Figure 2A:
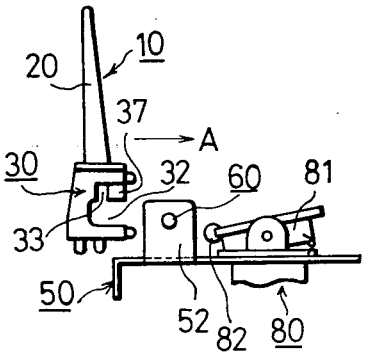
Figure 2C:
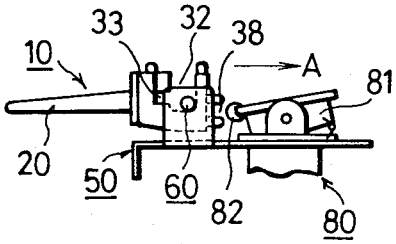
Figure 2B:
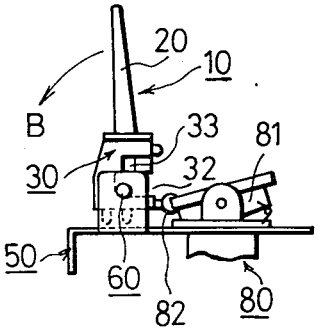
Figure 2D:
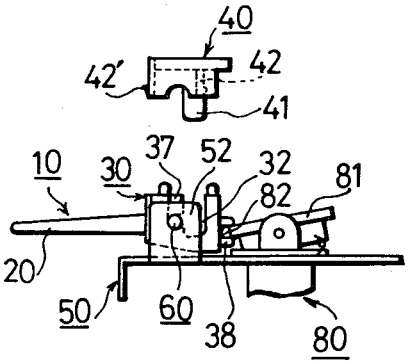

Referring to the drawings and more particularly to FIG. 1, an actuating member 10 made of a plastics material has a unitary construction including an elongated operating portion 20 and a base portion 30. The base portion 30 has a bore or cavity 31 for accomodating a cover member 40. A first slot 32 and a second slot 33 are formed adjacent one another in each side wall 34 of the base portion 30, so that the first slot 32 and the second slot 33 are joined with each other. The slots 32 and 33 extend downwardly form the top edge of the side wall 34 towards the bottom edge of the side wall, but the second slot 33 terminates at an intermediate portion of the first slot 32. Notch portions 35 and 35 are formed in the inner surface of the respective end walls 36 of the base portion. A pair of bar members 37 and 37 are formed in each side wall 34 of the base portion 30, and each extends transversely across the respective second slot 33 near the top edge portion of the side wall 34. The base portion 30 is also provided at its rear end with an engaging member 38 to be engaged with an engaging portion 82 of an actuator 81 of a switch body 80. The engaging member 38 consists of upper and lower teeth.

A cover member 40 made of a resilient plastics material has a unitary construction including a projection 41, a pair of legs 42 and 42 each extending downwardly from the top edge of the cover member 40 and having a hook or shoulder 42' at its lower end that is adapted to snap beneath the notch portions 35 of the base portion 30, and a slot 43 being formed in each side wall 44 of the cover member 40 to hold a mounting rod 60 after being assembled.

A base plate 50 has an opening 51 for mounting a switch body 80, and a bracket 52 stamped out from the opening 53 to form a support for the mounting rod 60 extending through an opening 54. Another support at the opposite end of the base plate 50 is not shown. Reference numeral 70 denotes a hair-pin spring for an actuator 81 of the switch body (FIG. 3).

The switch body 80 is well-known toggle-type switch, which may be used independently, having the actuator 81, and an electric circuit (not shown) to be switched by the actuator 81 which is pivotably mounted on a casing 83. The actuator 81 is provided with a cylinder-shape engaging portion 82 at the end portion thereof.

For mounting the actuating member 10 on the mounting rod 60, at first, the actuating member 10 is brought into the position as shown in FIG. *2a*, so that the first slot 32 faces the mounting rod 60. Subsequently, the actuating member 10 is pressed in the direction of arrow A so that the rod 60 enters the slots 32 and travels therethrough toward their closed ends (FIG. *2b*). Then the actuating member 10 is rotated around the rod 60 in the direction of arrow B until the operating portion 20 becomes parallel to the base plate 50 (FIG. *2c*). In this condition, the actuating member 10 is again pressed in the direction of arrow A so that the engaging member 38 of the actuating member 10 is brought into the engaging portion 82 of the actuator 81 (FIG. *2d*). Finally, a projection 41 and a pair of legs 42 and 42 of the cover member 40 are inserted into the cavity 31 of the base portion 30 so as to bring hooks 42' and 42' into engagement with notch portions 35 and 35. After having connected the cover member 40 with the actuating member 10, as shown in FIG. 3, the actuating member 10 is rotatably secured to the mounting rod 60 by means of the second slot 33, the projection 41 and the bar portion 37, as well as the slot 43 (not shown in FIG. 3) of the cover member 40.

Figure 3:
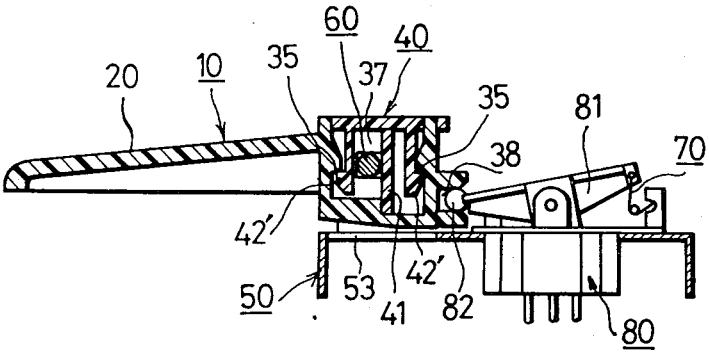
FIG. 3 is a sectional side elevational view of the switch after assembly.

As best seen from FIG. 3, movement of the operating portion 20 in upward or downward direction causes the engaging portion 82 to move the actuator 81 of the switch body 80 to switch the electric circuit (not shown).

To remove the actuating member 10 from the mounting rod 60, it can be easily accomplished by reversing the steps shown in FIG. *2a* to FIG. *2d*, after removing the cover member 40 from the actuating member 10 by using a pertinent tool which can disengage the engagement between leg 42 and notch portion 35.

While the apparatus hereinbefore described is effectively adapted to fulfill the objects stated, it is to be understood that it is capable of many modifications. Changes, therefore, in the construction and argument may be made without departing from the spirit and scope of the invention as disclosed in the appended claims.

What is claimed is:

1. A lever switch comprising (a) a base frame having supports for a mounting rod;

(b) a switch body secured to said base frame, said switch body having an actuator pivotably mounted thereon and having an engaging portion at an end portion thereof;

(c) an actuating member having an elongated operating portion and a base portion, said base portion comprising a first slot extending downwardly from the top edge of said base portion for guiding said mounting rod upon its insertion, a second slot adjacent said first slot for supporting said mounting rod, and an engaging member for engaging with said engaging portion of said actuator of the switch body;

(d) a cover plate connected to said base portion of said actuating member for holding said actuating member on said mounting rod, and (e) a fastening means for connecting said actuator member with said cover member.

2. A lever switch according to claim 1, said base portion of said actuating member further comprising a pair of bar members each adjacent to a respective one of said second slots to form a bearing for said mounting rod in cooperation with said second slot.

3. A lever switch according to claim 1, said fastening means comprising a pair of notch portions formed in said base portion of said actuating member and a pair of legs formed in said cover member.

4. A lever switch according to claim 3, said legs of said cover member each extending downwardly from the top edge of said cover member and having a hook at its end.

5. A lever switch according to claim 4, said legs being made from a resilient plastics material and adapted to be detachbly engaged with said notch portions of said base member.

6. A lever switch according to claim 1, said cover plate further including slots for preventing lateral movement of said mounting rod within said second slots.

7. A lever switch according to claim 1, said actuator of said switch body being provided with a cylinder-shape engaging portion at the end thereof to be accomodated to said engaging portion of said actuating member.

8. A lever switch according to claim 7, said engaging member of said actuating member consists of upper and lower teeth which may receive therebetween said cylinder-shape engaging portion of said actuator of said switch body.

* * * * *